United States Patent [19]

Hassell

[11] Patent Number: 4,658,988

[45] Date of Patent: Apr. 21, 1987

[54] MULTIPLE FLAVOR POST-MIX BEVERAGE DISPENSING APPARATUS

[75] Inventor: David A. Hassell, Anoka, Minn.

[73] Assignee: The Cornelius Company, Anoka, Minn.

[21] Appl. No.: 596,124

[22] Filed: Apr. 2, 1984

[51] Int. Cl.[4] ..... B67D 5/56

[52] U.S. Cl. ..... 222/129.1; 222/144.5; 137/607; 137/635; 137/1

[58] Field of Search ..... 222/129.1, 129.2, 129.3, 222/129.4, 144.5; 137/607

[56] References Cited

U.S. PATENT DOCUMENTS

| | | | |
|---|---|---|---|
| 603,465 | 5/1898 | Dredge et al. | 222/144.5 X |
| 1,370,759 | 3/1921 | Ouver | 222/144.5 X |
| 2,371,431 | 3/1945 | DiPietro | 222/144.5 X |
| 2,462,019 | 2/1949 | Bowman | 222/144.5 X |
| 3,396,871 | 8/1968 | McCann | 222/144.5 X |
| 3,460,717 | 8/1969 | Thomas | 222/129.1 |
| 3,759,422 | 9/1973 | Matheny | 222/144.5 X |

OTHER PUBLICATIONS

*Service Manual for Refreshop* TM *Coin-Operated Dispenser,* Apr. 12, 1978, The Cornelius Co.

*Primary Examiner*—Joseph J. Rolla
*Assistant Examiner*—Frederick R. Handren
*Attorney, Agent, or Firm*—Henry C. Kovar

[57] ABSTRACT

A multiple flavor post-mix beverage dispensing apparatus with a dispensing head having a nozzle, a normally closed water valve, a first normally closed primary syrup valve, a water line, and a primary syrup line, has a second normally closed primary syrup valve in a primary syrup line in series with the first valve, an alternative syrup line having a normally closed alternative syrup valve, a primary actuator switch for concurrently opening the water valve and both primary syrup valves while the alternative syrup valve is closed or dispensing only a primary beverage, and a second actuator switch for concurrently opening the water valve and alternate syrup valve while the second primary syrup valve remains closed for dispensing only an alternative beverage; an alternative construction has the same beverage componentry with a single actuator switch and a multiple pole double throw switch for selecting actuation circuitry for the primary beverage or the alternative beverage, an indicator light indicates which beverage is presently selected; the apparatus may be in the form of a kit for conversion of an existing single flavor dispensing valve into a multiple flavor dispensing head. A method of dispensing an alternative post-mixed beverage from a post-mix dispensing valve has the steps of opening a water valve and a primary syrup valve, closing a primary syrup line so primary syrup cannot flow, and opening a normally closed alternative syrup valve in an alternative syrup line to a dispensing nozzle. A plurality of alternative beverages may be added with the apparatus and method of this invention.

14 Claims, 2 Drawing Figures

MULTIPLE FLAVOR POST-MIX BEVERAGE DISPENSING APPARATUS

BACKGROUND OF THE INVENTION

1. Field of the Invention

This invention pertains to a multiple flavor post-mix beverage dispensing apparatus, to a kit for conversion of a single flavor post-mix beverage dispensing apparatus to a multiple flavor dispensing apparatus, and to a method of dispensing an alternative post-mixed beverage from a post-mix dispensing valve having a first and primary beverage.

2. The Prior Art

Electrically operable post-mix dispensing valves have usually had two solenoids. One solenoid will open a water valve and a second solenoid will open a syrup valve. The most common valve of this type is used by The Coca-Cola Company and manufactured by Alco Standard. This valve is shown and described in U.S. Pat. No. 3,540,476. A structure in kit form has been developed that enables this two-solenoid valve to dispense either its primary beverage or a second and alternative beverage. This valve has separate solenoids for water and primary syrup. This valve is known for dispensing warm drinks because of heat from the dual solenoids. The kit structure includes a secondary syrup valve. The dispensing valve is rewired with a bi-stable toggle switch which is flipped to either primary or secondary beverage. When a common actuator lever is depressed, a single switch then opens either the water valve and the primary syrup valve, or only the water valve and the alternate syrup valve. This kit will not work on single solenoid post-mix valves. This kit requires the use of a toggle switch to change from one beverage to another. The toggle switch must be correctly set upon the desired beverage before dispensing is begun.

A second example of a single flavor post-mix valve being converted into a three flavor post-mix valve is an effort by The Cornelius Company of Anoka, Minn. This effort pre-dates the previously described Coca-Cola and Alco Standard effort and was successfully reduced to practice at least as early as Apr. 12, 1978, but has not been patented in the U.S. or elsewhere. Cornelius manual No. 31-6318-000 of Apr. 12, 1978 documents this effort, which was done on a coin-actuatable cold-cup dispensing machine specifically for the Coca-Cola Company. The Cornelius device has a single dispensing head of the type shown in U.S. Pat. Nos. 3,455,332 and 3,667,724. This valve, which was originally a single solenoid valve, was rebuilt with two solenoids. There was a first solenoid on the water valve and a discrete second solenoid on the syrup valve. A pair of extra syrup lines were run into the nozzle of the dispensing head and each of the extra syrup lines had a discrete normally closed syrup solenoid valve. The electrical controls were a conventional vending machine panel with touch switches. The vending machine is shown in U.S. Pat. No. Des. 256,376. The control circuitry would open the dispensing head water valve and syrup valve for the primary beverage, which was usually Coca-Cola. For the second beverage, the water valve and the syrup solenoid valve in the first extra syrup line would be opened while the dispensing head syrup valve was left closed. For the third beverage, the water valve and the syrup solenoid valve in the second extra syrup line would be opened while the dispensing head syrup valve remained closed.

Neither of these prior efforts contemplated or devised conversion of a single solenoid single flavor post-mix head into a multiple flavor post-mix head. The problem with the single solenoid head is that both water and syrup valves are now opened by a single solenoid and selective control is not possible.

OBJECTS OF THE INVENTION

It is an object of the present invention to provide a multiple flavor post-mix beverage dispensing apparatus having a single nozzle with primary and alternative syrup lines and a valve and control structure enabling selective dispensing of either a primary or an alternative beverage.

It is an object of the present invention to restructure a single solenoid and single flavor post-mix beverage dispensing head into a multiple flavor dispensing head.

It is an object of the present invention to provide a kit for reconstruction of a single solenoid and single flavor post-mix beverage dispensing head into a multiple flavor head.

It is an object of the present invention to provide a new and improved method of dispensing an alternative post-mix beverage from a post-mix dispensing head which was originally a single flavor head.

These and other objects and advantages of the invention will become manifest upon examination of the teaching herein and upon practice with my invention.

SUMMARY OF THE INVENTION

In accordance with the principles of the present invention, a multiple flavor post-mix beverage dispensing apparatus has a nozzle, a normally closed water valve, a first normally closed primary syrup valve and a second primary syrup valve in a primary syrup line, a normally closed alternative syrup valve in an alternative syrup line to the nozzle, a primary actuator for concurrently opening the water valve and both primary syrup valves, and a secondary actuator for concurrently opening the water valve and alternative syrup valve while the primary syrup line remains closed.

A kit for conversion of a single flavor post-mix head into a multiple flavor post-mix dispensing head has a second primary syrup valve for installation into a primary syrup line upstream of an existing normally closed syrup valve, an alternative syrup line connectable to a nozzle, a normally closed alternative syrup valve, a primary actuator for opening the water valve and both primary syrup valves, and a secondary actuator for opening the water valve and alternative syrup valve while the primary syrup line remains closed.

A method of dispensing an alternative post-mixed beverage from a post-mix beverage dispensing head, has the steps of opening a normally closed water valve and primary syrup valve, closing a primary syrup line upstream of the opened primary syrup valve so primary syrup cannot flow, and opening a normally closed alternative syrup valve in an alternative syrup line, so that only an alternative syrup will flow together with water into a dispensing nozzle.

AS SHOWN ON THE DRAWINGS

Figure 1:
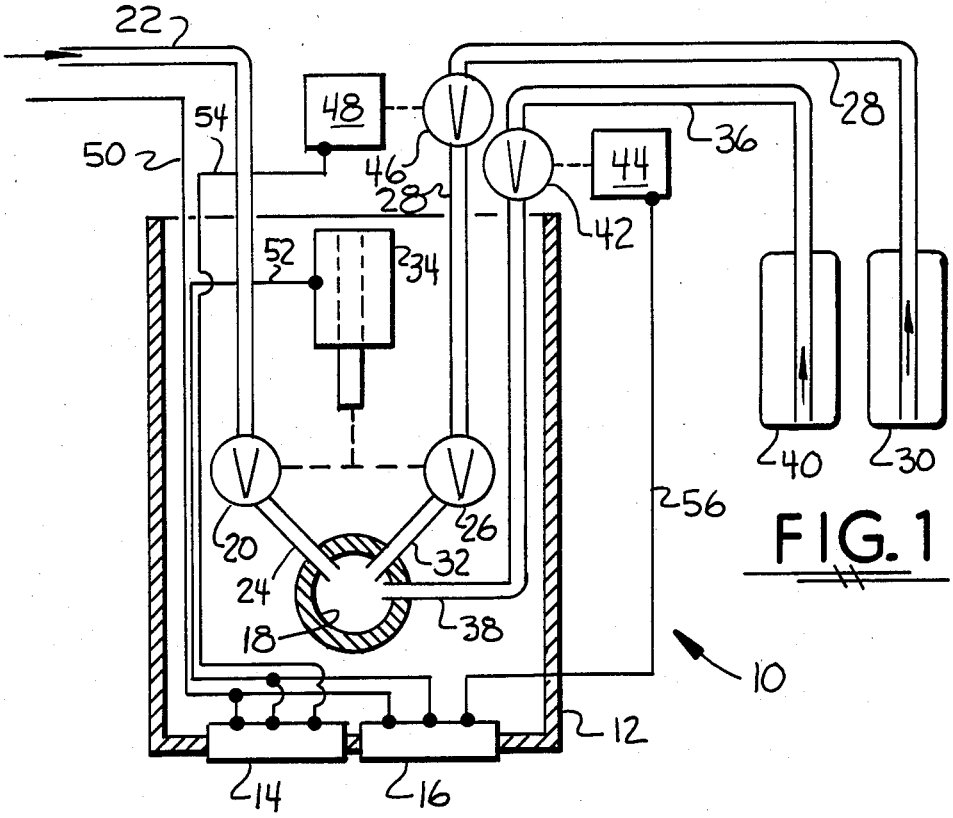
FIG. 1 is a schematic plan view of the structure of the preferred embodiment of a multiple flavor post-mix beverage dispensing apparatus according to the principles of the present invention, and for practicing the method of the present invention.

The principles of the present invention are particularly useful when embodied in a dispensing head of the type shown schematically in FIG. 1 and generally indicated by the numeral 10. The dispensing head 10 is commonly referred to by the beverage trade as a dispensing valve, but herein shall be referred to as the head 10 to distinguish it from the the individual liquid valves which will be subsequently discussed.

The head 10 has an exterior case 12, a first actuator switch 14 for a primary beverage, a second actuator switch 16 for a second or alternative beverage, and a dispensing nozzle 18 from which both the primary and alternative beverages are commonly dispensed.

The head 10 has a normally closed water valve 20 to which is connected a carbonated water supply line 22 having an outlet line 24 extending from the water valve 20 to the nozzle 18. The head 10 has a first primary syrup valve 26 in a primary syrup line 28 which has at one end a source 30 of primary syrup and at the other end an outlet line 32 into the nozzle 18. The head 10 has an electrical solenoid 34 which is commonly connected to the valves 20, 26 to concurrently open both of the normally closed valves 20, 26.

An alternative syrup line 36 has an outlet 38 plumbed into the nozzle 18, and a source 40 of an alternative or second syrup at the other end. Within the alternative syrup line 36 is normally closed alternative syrup valve 42 which is openable by an alternative syrup valve solenoid 44.

An important feature of the present invention is a second primary syrup valve 46 installed in the primary syrup line 28 upstream of the first or main primary syrup valve 26. An electrical solenoid 48 is connected to open the normally closed second primary syrup valve 46.

In the electrical wiring, as shown in FIG. 1, power line 50 is commonly connected to both actuator switches 14, 16. Power line 50 is preferably low voltage. Each actuator switch 14, 16 has an output pole connected by a main solenoid lead 52 to the solenoid 34 for the water valve 20 and the first primary syrup valve 26. The first or primary switch 14 has a second output pole connected to the second primary syrup valve solenoid 48 by a lead 54. The second or alternative beverage switch 16 has an output pole connected to the alternative syrup valve solenoid 44 by a lead 56.

This head 10 can be manufactured complete in a factory. A kit having the switches 14, 16, leads 52, 54, 56, the second primary syrup valve 46 and solenoid 48, alternative syrup line 36, 38 and alternative syrup valve 42 and solenoid 44 can also be packaged and sold as a kit for installation in and on single solenoid post-mix valves such as shown in Forrest L. Austin U.S. patent application Ser. No. 415,505, filed on Sept. 7, 1982 now U.S. Pat. No. 4,549,675 of Oct. 29, 1985.

In operation and use of the head 10 and in the practice of the method of the present invention, switch 14 is depressed if dispensing of the primary beverage is desired. Current is fed via lead 52 to the solenoid 34 which concurrently opens the water valve 20 and the first primary syrup valve 26, and via lead 54 to solenoid 48 which also concurrently opens the second primary syrup valve 46. Concurrent opening of the valves 20, 26 and 46 allows water and the primary syrup to flow into and out of nozzle 18 to dispense the primary beverage. When the primary switch 14 is released, the solenoids 34, 48 are simultaneously de-energized, the valves 20, 26, 46 simultaneously close and dispensing of the primary beverage ceases.

The second switch 16 is depressed when dispensing of the alternative beverage is desired. Current is supplied via lead 52 to solenoid 34 which opens the water valve 20 and the first primary syrup valve 26. Current is also concurrently supplied to the alternative syrup solenoid 44 via lead 56 which simultaneously and concurrently opens the alternative syrup valve 42. Water flows into the nozzle 18 as does alternative syrup to dispense the alternative or second post-mixed beverage, but the primary syrup cannot flow because the primary syrup supply line 28 is closed by the second primary syrup valve 46. When the alternative beverage switch 16 is released, solenoids 34 and 44 are simultaneously de-energized and valves 20, 26 and 42 simultaneously close and dispensing of the alternative beverage ceases.

Either the primary or alternative beverage may be selected at will and in any sequence.

Figure 2:
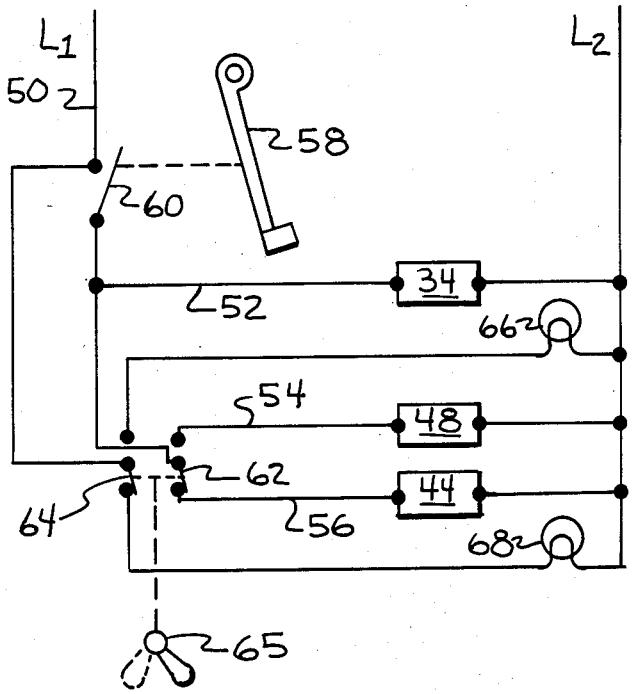
FIG. 2 is a schematic drawing of an alternative electrical control system for the structure of FIG. 1.

FIG. 2 illustrates a schematic for an alternative electrical control embodiment usable with and on the fluid componentry of the head 10 as shown in FIG. 1. The head 10 has an optional actuator lever 58 against which a cup is pushed. The lever 58 is connected to close an actuator switch 60 when pushed in by a cup. A first output of the lever switch 60 is connected to the main solenoid 34 via lead 52. A second lead 61 connects the output of the lever switch 60 to a first bi-stable single pole double throw switch (SPPT) 62. The switch 62 has a first output pole connected via lead 54 to the solenoid 48 on the second primary syrup valve 46 and a second output pole connected via lead 56 to the solenoid 44 on the alternative syrup valve 42. A second lead 63 coming from the lever switch 60 is connected to a common pole on a second double throw switch 64. This switch 64 has a first output pole connected to a first indicator light 66 and a second output pole connected to a second indicator light 68. Lead 63 is always connected to power so that one of the indicator lights 66, 68 is always on. Lead 61 is connected to the output of lever switch 60 and is energized only when the lever switch 60 is closed. The two switches 62, 64 are interconnected to construct a bi-stable double-pole double-throw (DPDT) switch under the control of a toggle 65 that can flip the DPDT switch 62, 64 as the user selects.

When the toggle 65 and DPDT switch 62, 64 is thrown as shown, the indicator light 68 is on indicating that the secondary beverage will be dispensed if the lever 58 is pushed in. When the lever switch 60 is closed, power is sent to the main solenoid 34 which opens the water valve 20 and first primary syrup valve 26 as previously described. Power is also sent to the alternative solenoid 44 which opens the alternative solenoid 42 to allow flow of the alternative syrup and dispensing of the alternative beverage. When the lever switch 60 is opened, the solenoids 34, 44 are deenergized and dispensing ceases.

To dispense the primary beverage, the toggle 65 and DPDT switch 62, 64 are thrown to the other side and then when the lever switch 60 is closed, the solenoid 34 is again actuated to open the water valve 20 and first primary syrup valve 26 and the solenoid 48 is energized to open the second primary syrup valve 46 allowing primary syrup to flow and the primary post-mix beverage to be dispensed.

The step of closing the primary syrup line 28 when dispensing the alternative beverage is an important feature of this invention. This invention enables a single-solenoid post-mix head to be easily converted into a multiple flavor post-mix head. It enables the manufacture of a multiple-flavor post-mix head utilizing the tooling and proven developments in a single flavor post-mix head. The method of the present invention enables the dispensing of many more beverages from dispensers of proven value, reliability and performance. This invention can be further expanded to three, four or more flavors by the addition of further alternative lines, solenoid valves and switches.

Although various minor modifications may be suggested by others versed or experienced in the art, it should be understood that I wish to embody within the scope of the patent warranted hereon, all such embodiments as reasonably and properly come within the scope of my contribution to the art.

I claim as my invention:

1. A multiple flavor post-mix beverage dispensing apparatus comprising (a) a dispensing head having a nozzle, a normally closed water valve fluidly connected to the nozzle, a first normally closed primary syrup valve fluidly connected to the nozzle, a water line to the water valve, and a primary syrup line to the syrup valve for connection of the head to a source of primary beverage syrup;

(b) a second primary syrup valve in the primary syrup line;

(c) an alternative syrup line to the nozzle for connection of the head to a discrete source of an alternative beverage syrup;

(d) a normally closed aternative syrup valve in the alternative syrup line;

(e) primary actuation means for concurrently opening the water valve and both syrup valves in the primary syrup line while the alternative syrup valve in the alternative syrup line is closed, for dispensing a primary beverage;

(f) secondary actuation means for concurrently opening the water valve and the alternative syrup valve in the alternative syrup line, while the second primary syrup valve is closed, for dispensing an alternative beverage from the head; and (g) in which the water valve and the first primary syrup valve are commonly connected to said primary actuation means, said primary actuation means including a single actuator, for effecting the operation of the primary actuation means.

2. The apparatus of claim 1, in which said second primary valve is a normally closed valve.

3. The apparatus of claim 1, in which the primary actuation means includes an actuation switch connected to a solenoid for the water valve and the first primary syrup valve, and to a solenoid for the second primary syrup valve.

4. The apparatus of claim 1, in which said primary and secondary actuation means jointly comprise (a) a single dispensing switch having an output pole connected to a solenoid for the water valve and the first primary syrup valve;

(b) a first SPDT switch having a first output pole connected to a solenoid for the second primary syrup valve, and a second output pole connected to a solenoid for the alternative syrup valve.

5. The apparatus of claim 4, including (a) a second SPDT switch having a common pole connected to line power on the input side of the dispensing switch;

(b) a primary beverage indicator light connected to a first output pole of the second SPDT switch;

(c) a secondary beverage indicator light connected to a second output pole of the second SPDT switch;

(d) said first and second SPDT switches being operatively connected so that (1) the primary beverage indicator light is on when the second primary syrup valve solenoid is functionally connected to the dispensing switch, and (2) the secondary beverage indicator light is on when the alternative syrup valve solenoid is functionally connected to the dispensing switch;

6. A multiple flavor post-mix beverage dispensing apparatus comprising (a) a dispensing head having a nozzle, a normally closed water valve fluidly connected to the nozzle, a first normally closed primary syrup valve fluidly connected to the nozzle, a water line to the water valve, and a primary syrup line to the syrup valve for connection of the head to a source of primary beverage syrup;

(b) a second primary syrup valve in the primary syrup line;

(c) an alternative syrup line to the nozzle for connection of the head to a discrete source of an alternative beverage syrup;

(d) a normally closed alternative syrup valve in the alternate syrup line;

(e) primary actuation means for concurrently opening the water valve and both syrup valves in the primary syrup line while the alternative valve in the alternative syrup line is closed, for dispensing a primary beverage;

(f) secondary actuation means for concurrently opening the water valve and the alternative syrup valve in the alternative syrup line, while the second primary syrup valve is closed, for dispensing an alternative beverage from the head; and (g) in which said secondary actuation means includes an actuator switch operatively connected to a solenoid for the water valve and the primary syrup valve, and to a solenoid for the alternative syrup valve.

7. A multiple flavor post-mix beverage dispensing apparatus comprising (a) a dispensing head having a nozzle, a normally closed water valve fluidly connected to the nozzle, a first normally closed primary syrup valve fluidly connected to the nozzle, a water line to the water valve, and a primary syrup line to the syrup valve for connection of the head to a source of primary beverage syrup;

(b) a second primary syrup valve in the primary syrup line;

(c) an alternative syrup line to the nozzle for connection of the head to a discrete source of an alternative beverage syrup;

(d) a normally closed alternative syrup valve in the alternate syrup line;

(e) primary actuation means for concurrently opening the water valve and both syrup valves in the primary syrup line while the alternative valve in the alternative syrup line is closed, for dispensing a primary beverage;

(f) secondary actuation means for concurrently opening the water valve and the alternative syrup valve in the alternative syrup line, while the second primary syrup valve is closed, for dispensing an alternative beverage from the head;

(g) said primary means having a first switch having a first pole connected to line power, a second pole connected to a primary solenoid for the water and first primary syrup valves, and a third pole connected discretely to a solenoid for the second primary syrup valve; and in which (h) said secondary actuation means is a second switch having a first pole connected to line power in parallel with said first switch first pole, a second pole connected to the primary solenoid in parallel with the second pole of the first switch, and a third pole connected discretely to a solenoid for the alternative syrup valve.

8. A kit for conversion of a single flavor post-mix beverage head into a multiple flavor post-mix head, comprising:

(a) a second primary syrup valve for installation into a primary syrup line upstream of an existing normally closed syrup valve;

(b) an alternative syrup line connectable to a source of secondary syrup and having an outlet fluidly connectable to a nozzle of the valve;

(c) a normally closed alternative syrup valve for installation in the alternative syrup line;

(d) primary actuation means connectable to opening means for opening a water valve and a primary syrup valve in the dispensing head and to the second primary syrup valve, said actuation means being operable for concurrently opening the water valve, the primary syrup valve and the second primary syrup valve for dispensing a first and primary beverage from the head;

(e) secondary actuation means connectable to the opening means for opening the water valve and to the alternate syrup valve, said secondary actuation means being operable for concurrently opening the water valve and the alternative syrup valve while the second primary syrup valve remains closed, for dispensing an alternative beverage from the dispensing head;

(f) said primary actuating means having a first switch having a first pole connectable to line power, a second pole connectable to a primary solenoid for the water valve and the primary syrup valve, and a third pole discretely connectable to a solenoid for the second primary syrup valve; and in which (g) said secondary actuation means includes a second switch having a first pole connectable to the line power in parallel with said first switch first pole, a second pole connectable in parallel with said first switch second pole to said primary solenoid, and a third pole directly connectable to a solenoid for the alternative syrup valve.

9. A kit for conversion of a single flavor post-mix beverage head into a multiple flavor post-mix head, comprising:

(a) a second primary syrup valve for installation into a primary syrup line upstream of an existing normally closed primary syrup valve;

(b) an alternative syrup line connectable to a source of secondary syrup and having an outlet fluidly connectable to a nozzle of the head;

(c) a normally closed alternative syrup valve for installation in the alternative syrup line;

(d) primary actuation means connectable to opening means for opening a water valve and said normally closed primary syrup valve in the dispensing head and to the second primary syrup valve, said actuation means being operable for concurrently opening the water valve, the normally closed primary syrup valve and the second primary syrup valve for dispensing a first and primary beverage from the head;

(e) secondary actuation means connectable to the opening means for opening the water valve and to the alternate syrup valve, said secondary actuation means being operable for concurrently opening the water valve and the alternative syrup valve while the second primary syrup valve remains closed, for dispensing an alternative beverage from the dispensing head; and (f) in which the primary and secondary actuation means jointly include an SPDT switch having an input pole connectable to the output of a single dispensing switch, a first output pole connectable to a solenoid for the second primary syrup valve, and a second outlet pole connectable to a solenoid for the alternative syrup valve.

10. A kit according to claim 9, including a second SPDT switch connectable to an input side of the dispensing switch;

a primary beverage indicator light connected to a first output pole of the second SPDT switch;

a secondary beverage indicator light connected to a second output pole of the second SPDT switch; and means for commonly operating both SPDT switches.

11. A method of dispensing an alternative post-mixed beverage from a post-mix beverage dispensing head having a first and primary beverage, comprising the steps of:

(a) opening a normally closed water valve in a water line from a water source to a dispensing nozzle and opening a normally closed primary syrup valve in a primary syrup line from a primary syrup source to the dispensing nozzle;

(b) closing the primary syrup line at a location upstream of a location of the opened primary syrup valve so that water will flow but primary syrup cannot flow;

(c) concurrently opening a normally closed alternative syrup valve in a secondary syrup line leading from an alternative syrup source to the dispensing nozzle, so that an alternative syrup rather then the primary syrup will flow to the nozzle; and in which (d) said water valve, primary syrup valve and alternative syrup valve are all simultaneously opened, and in which said primary syrup line is closed prior to said simultaneous openings.

12. The method of claim 11, in which the water valve and the normally closed primary syrup valve are concurrently opened by a single movement, and are subsequently concurrently closed by a reversed single movement, said alternative syrup valve being concurrently opened by a different movement.

13. The method of claim 11, including the step of normally maintaining the primary syrup line open upstream of the primary syrup valve, and simultaneously opening the primary syrup valve and closing the primary syrup line upstream of the primary syrup valve to preclude primary syrup flow, while dispensing alternative beverage.

14. A method of firstly dispensing an alternative post-mixed beverage and secondly a primary post-mixed beverage from a single post-mix beverage dispensing head having a first and primary beverage, comprising the steps of:

(a) opening a normally closed water valve in a water line from a water source to a dispensing nozzle and opening a normally closed primary syrup valve in a primary syrup line from a primary syrup source to the dispensing nozzle;

(b) closing the primary syrup line at a location upstream of a location of the opened primary syrup valve so that water will flow but primary syrup cannot flow;

(c) concurrently opening a normally closed alternative syrup valve in a secondary syrup line leading from an alternative syrup source to a dispensing nozzle, so that an alternative syrup rather than the primary syrup will flow to the nozzle, and dispensing an alternative beverage;

(d) subsequently closing the water valve and the primary syrup valve and the alternative syrup valve so that the alternative syrup and alternative beverage cannot further flow;

(e) opening the primary syrup line at said location upstream of the primary syrup valve; and (f) reopening the normally closed water valve and the normally closed primary syrup valve simultaneously with the upstream opening of the primary syrup line, and dispensing primary beverage from the head.

* * * * *